US007798884B2

(12) United States Patent
Barcelo

(10) Patent No.: US 7,798,884 B2
(45) Date of Patent: Sep. 21, 2010

(54) TOY CONSTRUCTION SYSTEM

(76) Inventor: Nathalie Barcelo, 775, Davaar, Outremont, Quebec (CA) H2V 3B3

( * ) Notice: Subject to any disclaimer, the term of this patent is extended or adjusted under 35 U.S.C. 154(b) by 811 days.

(21) Appl. No.: 11/596,298

(22) PCT Filed: May 13, 2005

(86) PCT No.: PCT/CA2005/000800

§ 371 (c)(1),
(2), (4) Date: Nov. 13, 2006

(87) PCT Pub. No.: WO2005/110571

PCT Pub. Date: Nov. 24, 2005

(65) Prior Publication Data

US 2008/0045116 A1 Feb. 21, 2008

(51) Int. Cl.
*A63H 33/08* (2006.01)

(52) U.S. Cl. ..... 446/124; 446/85; 446/97; 446/120

(58) Field of Classification Search ..... 446/97, 446/99, 100, 101, 120, 121, 124–128, 108, 446/109, 111, 116
See application file for complete search history.

(56) References Cited

U.S. PATENT DOCUMENTS 2,649,803 A * 8/1953 Andre ..... 446/104
2,714,269 A * 8/1955 Stafford ..... 59/80
2,885,822 A * 5/1959 Onanian ..... 446/121
3,066,501 A 9/1959 Charles et al.
3,510,979 A * 5/1970 Fischer ..... 446/102
3,747,261 A * 7/1973 Salem ..... 446/104
3,822,499 A * 7/1974 De Vos ..... 446/121
4,617,001 A * 10/1986 Parein ..... 446/102
5,645,464 A * 7/1997 Chen ..... 446/120
6,736,691 B1 * 5/2004 Bach ..... 446/128

FOREIGN PATENT DOCUMENTS

GB 400355 10/1933

* cited by examiner

*Primary Examiner*—Gene Kim
*Assistant Examiner*—Scott Young

(57) ABSTRACT

A toy construction system includes a block component and a connector component. The connector component has a connector-to-block coupling section for releasable coupling to the block component and a connector-to-connector coupling section for releasable coupling to a substantially similar connecting component. The connector-to-block coupling section defines a connector block contacting surface for contacting the block component. The coupling aperture defines a peripheral edge retaining section made out of a substantially resiliently deformable material. The peripheral edge retaining section is configured, sized and positioned so that when the block and connector components are in a component assembled configuration, the connector block contacting surface substantially deforms the peripheral edge retaining section to a retaining configuration for positively retaining the latter; and when the connector block contacting surface is spaced from the peripheral retaining section, the latter resiliently springs back to a non-retaining configuration.

15 Claims, 21 Drawing Sheets

15a
18
12
15b
18'
12
15c
18'
18
12
15d
18
12
15e
18'
12
15f
18'
18
12
15g
18
12
15h
18'
12
15i
18'
18
18
12
15j
18
12
15k
18'
12
15l
18
18'
18
18
12

16a
16b
16c
16d
16e
16f
16g
16h
16i
16 j
16 k
16 l
12
18"
18'
18

12
14'

12
18'
18''
14'

12

18''
12

12
18''

18'
12
18''

12

12
18''

TOY CONSTRUCTION SYSTEM

FIELD OF THE INVENTION

The present invention relates to the general field of toys and is particularly concerned with a toy construction system.

BACKGROUND OF THE INVENTION

The prior art is replete with various types of construction systems for use as toys. Although somewhat popular, most prior art construction systems suffer from numerous drawbacks. One such drawback is that most prior art toy construction systems include building components presenting an inherent poor versatility hence only allowing for a limited number of assembly configurations.

Other toy construction systems have attempted to circumvent such a drawback by providing a relatively large number of building components with limited success. Furthermore, they are often associated with relatively high manufacturing costs.

Yet, still, other prior art toy construction systems, while having building blocks offering some level of versatility suffer from the fact that they inherently do not allow for the construction of configurations having interesting visual characteristics. Accordingly, there exists a need for an improved toy construction system. It is a general object of the present invention to provide such an improved toy construction system.

SUMMARY OF THE INVENTION

In accordance with the present invention, there is provided a toy construction system comprising: a block component and a connector component; the connector component having a connector-to-block coupling section for releasable coupling to the block component and a connector-to-connector coupling section for releasable coupling to a substantially similar connecting component; the connector-to-block coupling section defining a connector block contacting surface for contacting the block component; the block component having a block coupling aperture extending at least partially therethrough, the block coupling aperture having a coupling aperture peripheral edge; the coupling aperture peripheral edge defining a peripheral edge retaining section made out of a substantially resiliently deformable material, the peripheral edge retaining section being configured, sized and positioned so that when the block and connector components are in a component assembled configuration relative to each other, the connector block contacting surface substantially deforms at least a portion of the peripheral edge retaining section to a retaining configuration for positively retaining the latter; and when the connector block contacting surface is spaced from the at least a portion of the peripheral retaining section, the latter resiliently springs back to a non-retaining configuration.

Advantages of the present invention include that the proposed toy construction system provides an intended user with a relatively large number of options for forming and reforming the toy into a relatively large number of configurations. Also, the proposed toy construction system allows for the construction of various configurations through the use of a relatively limited number of basic components so as to be adaptable to a wide range of intellectual level challenges and, hence, so as to be appealing to a relatively large segment of the population including relatively young children.

Also, the proposed toy construction system allows for the assembly of its components through a set of quick and ergonomic steps without requiring special tooling or manual dexterity. Still furthermore, the proposed toy construction system allows an intended user to build structures resembling animals, persona, vehicles, building, scenic views and the like in a relatively realistic fashion.

Yet, still furthermore, the proposed toy construction system includes building components that are relatively pleasant to manipulate, being deprived of relatively sharp and hard edges so as to be particularly well suited for use by children and enjoyable for all.

Also, the proposed toy construction system is designed so that its components may be manufacturable using conventional forms of manufacturing and conventional materials so as to provide a toy construction system that will be economically feasible, long-lasting and relatively trouble-free in operation.

BRIEF DESCRIPTION OF THE DRAWINGS

Embodiments of the present invention will now be disclosed, by way of example, in reference to the following drawings in which.

DETAILED DESCRIPTION

Figure 1A:
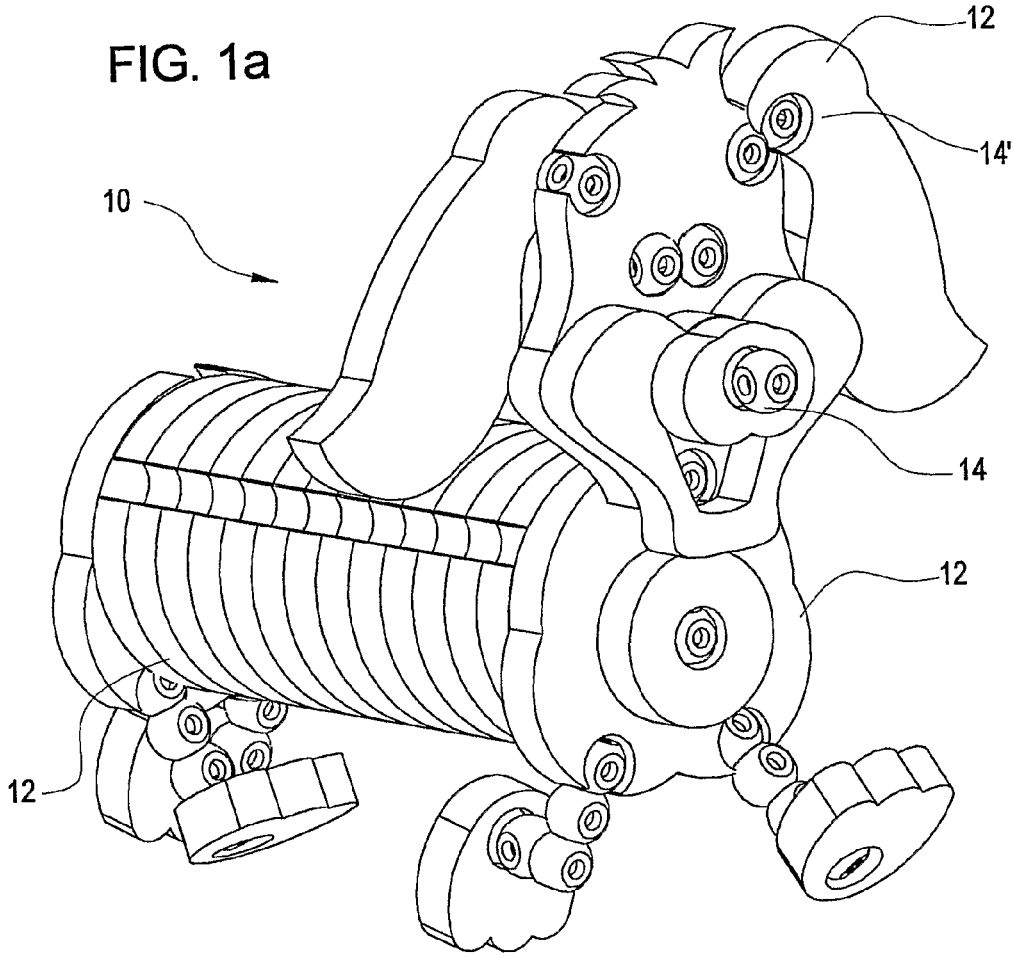
FIG. 1*a*, in a perspective view, illustrates a toy construction system in accordance with an embodiment of the present invention, the toy construction system being shown assembled in the form of a walking dog.
Figure 1B:
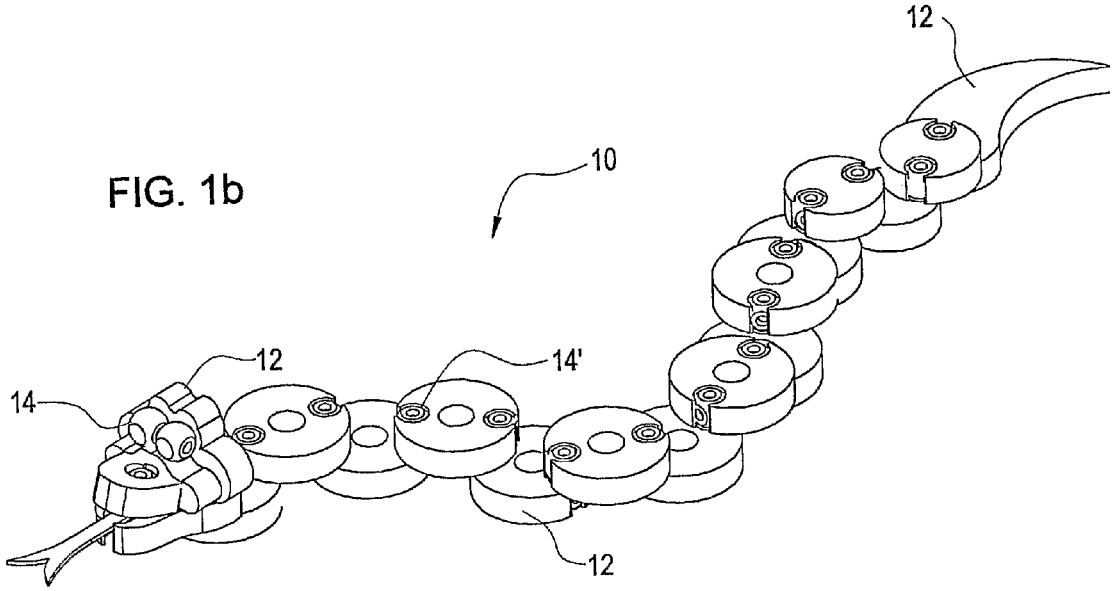
FIG. 1*b*, in a perspective view, illustrates a toy construction system in accordance with an embodiment of the present invention, the toy construction system being shown assembled in the general configuration of a snake.
Figure 1C:
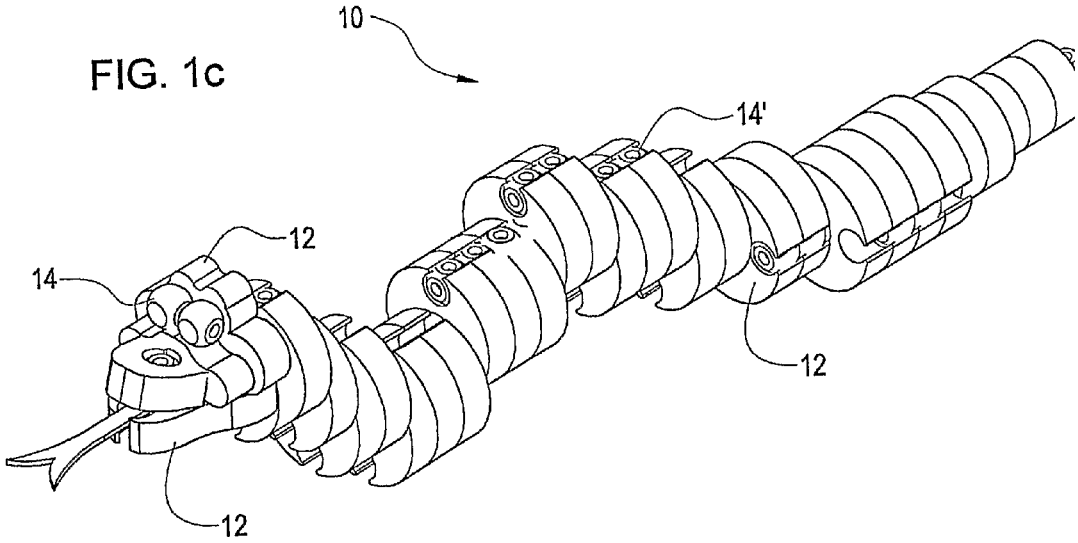
FIG. 1*c*, in a perspective view, illustrates a toy construction system in accordance with an embodiment of the present invention, the toy construction system being shown assembled in the general configuration of a snake.
Figure 1D:
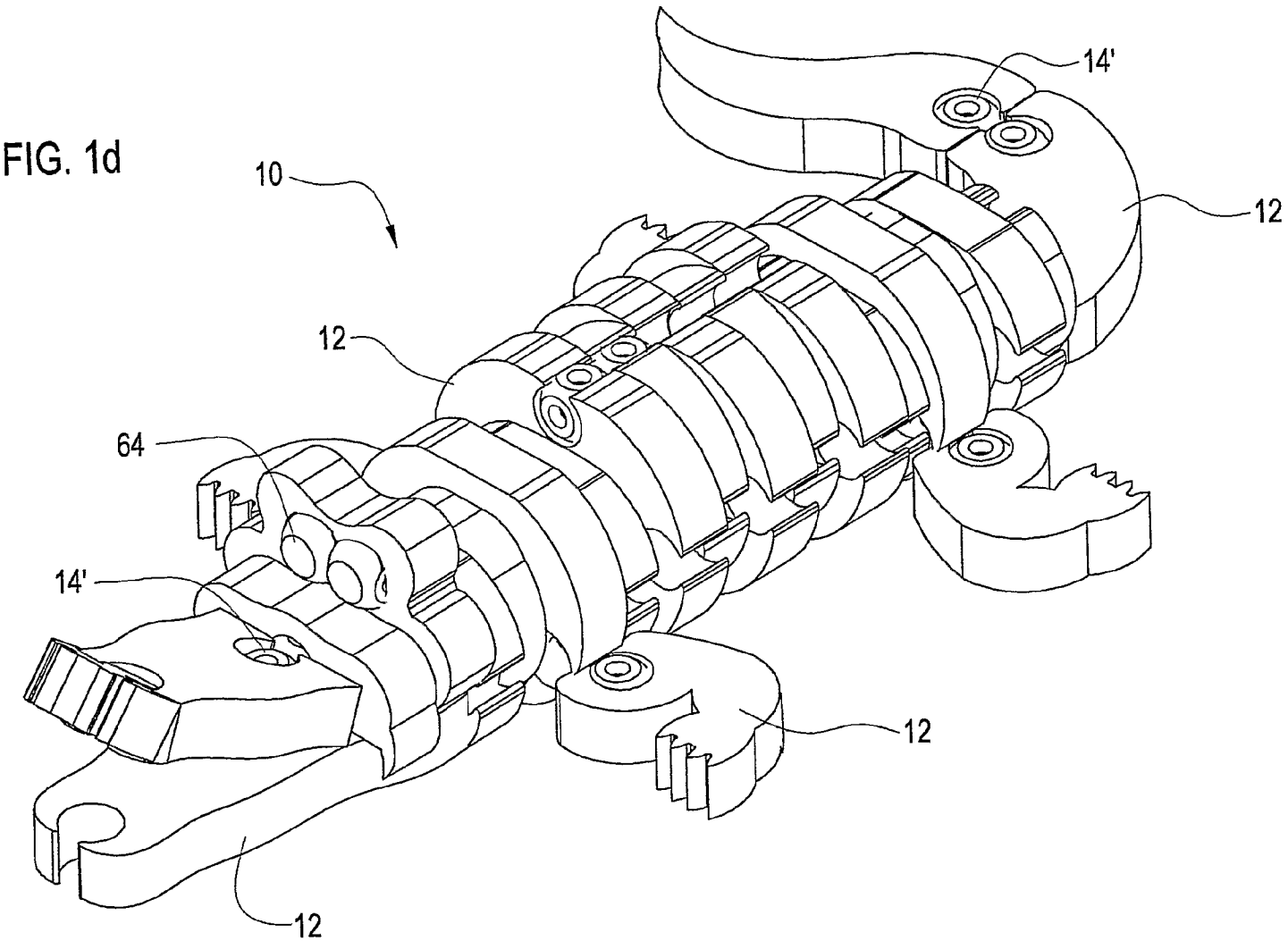
FIG. 1*d*, in a perspective view, illustrates a toy construction system in accordance with an embodiment of the present invention, the toy construction system being shown assembled in the general configuration of a crocodile.
Figure 1F:
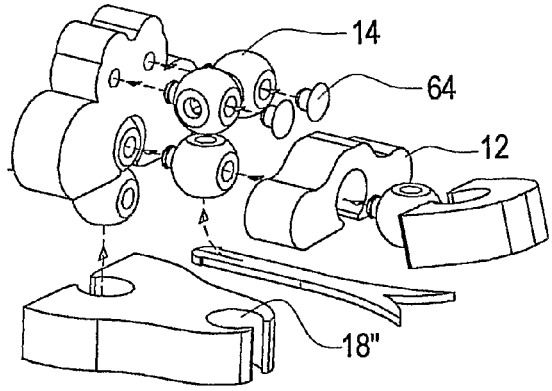
FIG. 1*f*, in an exploded view, illustrates a toy construction system in accordance with an embodiment of the present invention, the toy construction system being shown about to be assembled in the general configuration of the head of the snake shown in FIG. 1*e;*
Figure 1E:
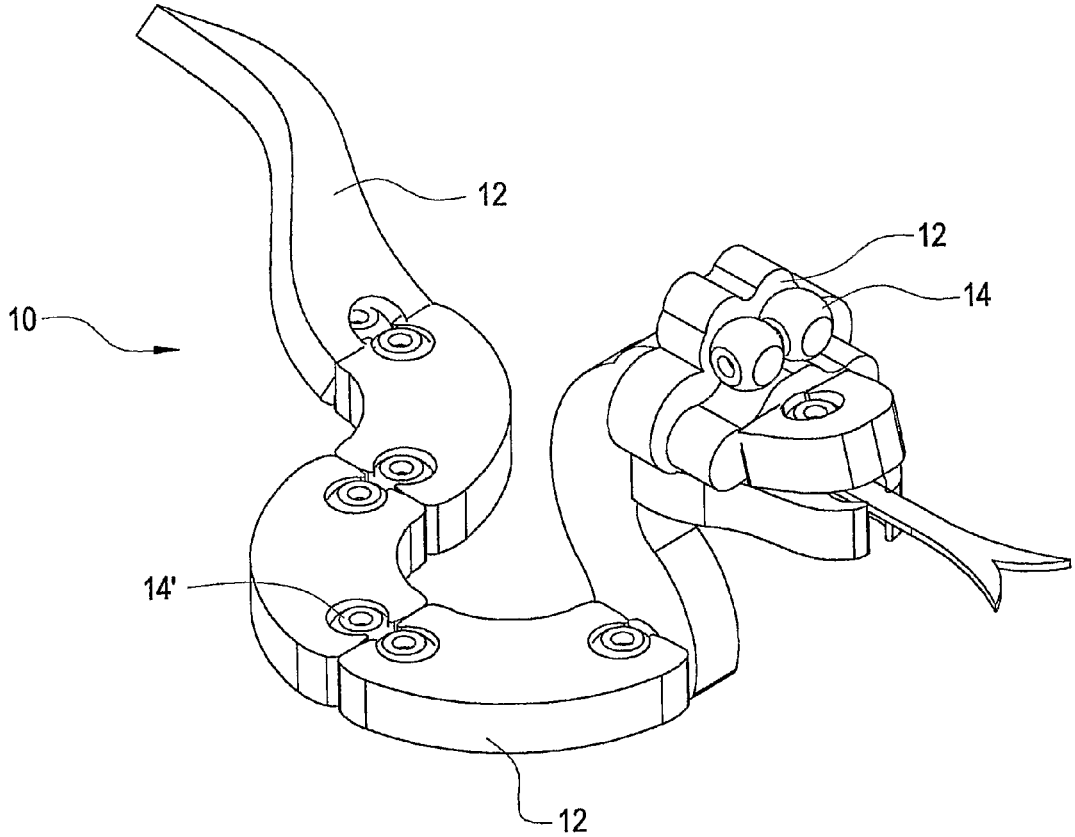
FIG. 1*e*, in a perspective view, illustrates a toy construction system in accordance with an embodiment of the present invention, the toy construction system being shown assembled in the general configuration of a snake.
Figure 1G:
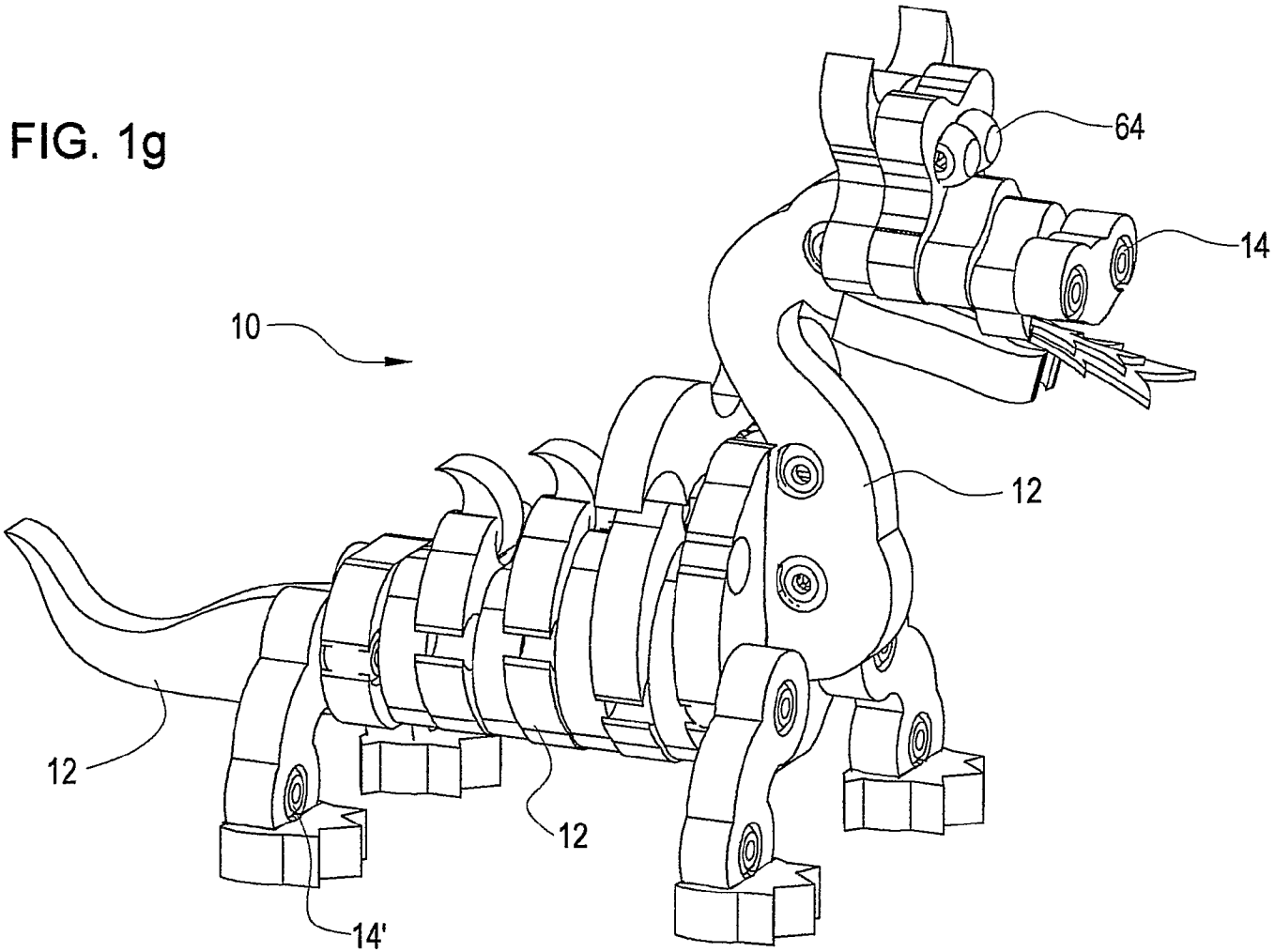
FIG. 1*g*, in a perspective view, illustrates a toy construction system in accordance with an embodiment of the present invention, the toy construction system being shown assembled in the general configuration of a dragon.
Figure 1H:
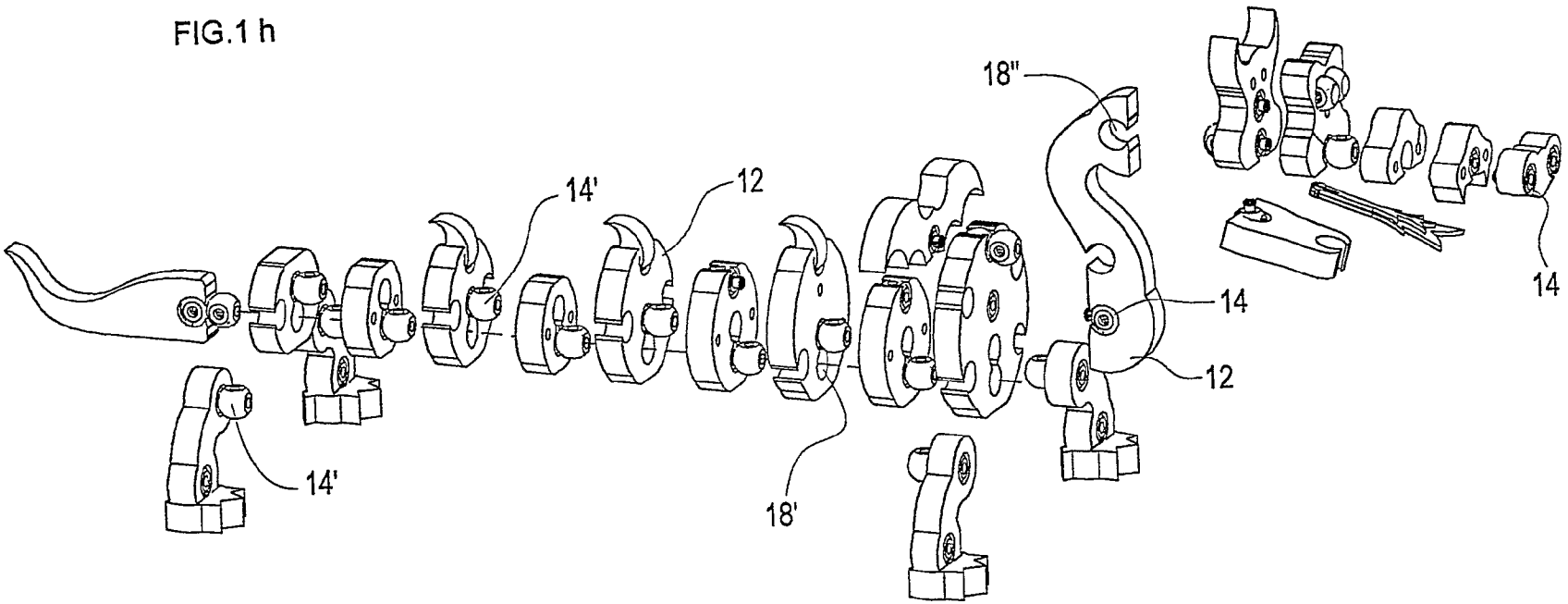
FIG. 1*h*, in an exploded view, illustrates a toy construction system in accordance with an embodiment of the present invention, the toy construction system being shown about to be assembled in the general configuration of the dragon shown in FIG. 1*g;*

Referring to FIGS. 1*a* through 1*e* and 1*g*, there is shown a toy construction system in accordance with an embodiment of the present invention assembled in various configurations, the toy construction system being generally indicated by the reference numeral 10. In FIG. 1*a*, the toy construction system 10 is shown assembled in the general configuration of a walking dog; in FIG. 1*b*, the toy construction system 10 is shown assembled in the general configuration of a snake; in FIG. 1*c*, the toy construction system 10 is shown assembled in the general configuration of another type of snake; in FIG. 1*d*, the toy construction system 10 is shown assembled in the general configuration of a crocodile; in FIG. 1*e*, the toy construction system 10 is shown assembled in the general configuration of yet another type of snake; in FIG. 1*g*, the toy construction system 10 is shown assembled in the general configuration of a dragon.

It should, however, be understood that FIGS. 1*a* through 1*e* and 1*g* are only shown by way of example and that the toy construction system 10 could be assembled in any suitable configuration using any suitable number of components without departing from the scope of the present invention.

Figure 15:
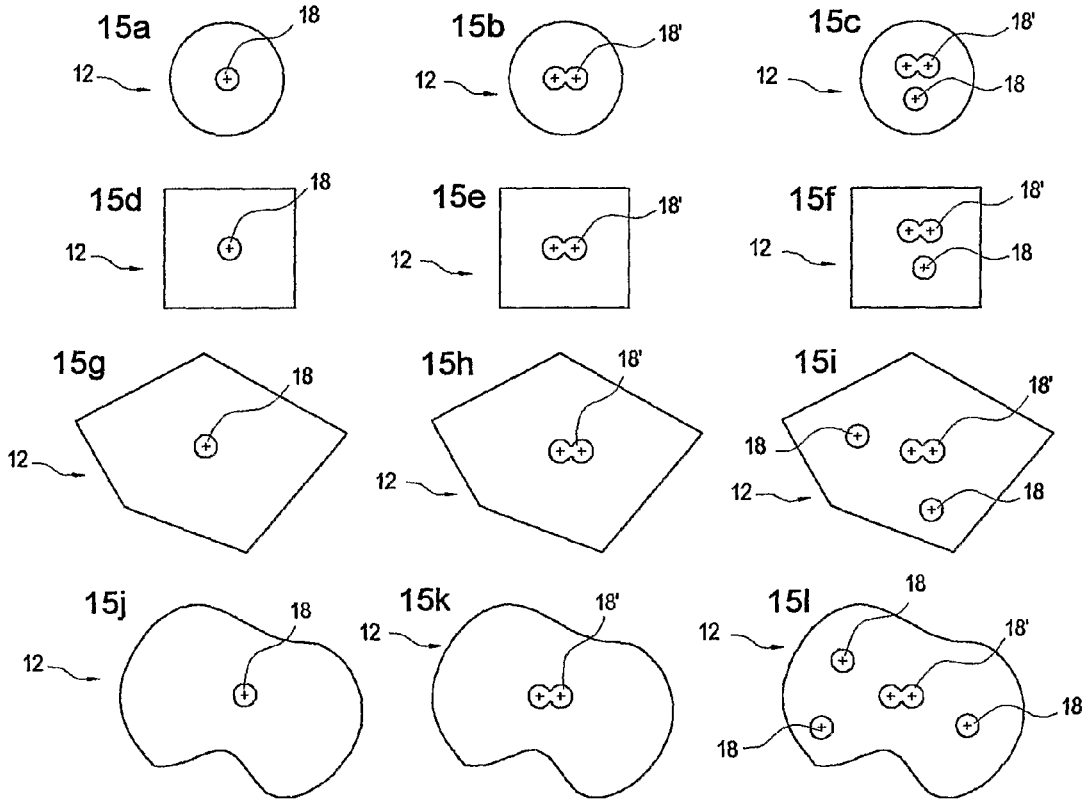
FIGS. 15*a* through 15*l*, in top views, illustrate various configurations of block components part of a toy construction system in accordance with an embodiment of the present invention, the block components being provided with block coupling apertures extending therethrough, the block coupling apertures being positioned within the outer perimeter of the block components.

The toy construction system 10 includes block components 12 such as illustrated by way of example in FIGS. 15*a* though 15*l* and 16*a* through 16*l* and connector components 14, 14' such as illustrated by way of example in FIGS. 2 through 9. Again, it should be understood that the block components shown in FIGS. 15*a* through 15*l* and 16*a* through 16*l* are only shown by way of example and that block components 12 having other configurations could be used without departing from the scope of the present invention. Similarly, the connector components 14, 14' shown in FIGS. 2 through 9 are also shown by way of example and other connector components 14 having similar features could be used without departing from the scope of the present invention.

Each connector component 14 has a connector-to-block coupling section for releasable coupling to a block component 12 and a connector-to-connector coupling section for releasable coupling to a substantially similar connector component 14. As illustrated more specifically 17 through 19, the connector-to-block coupling section defines a connector block contacting surface 16 for contacting a corresponding block component 12.

Figure 2:
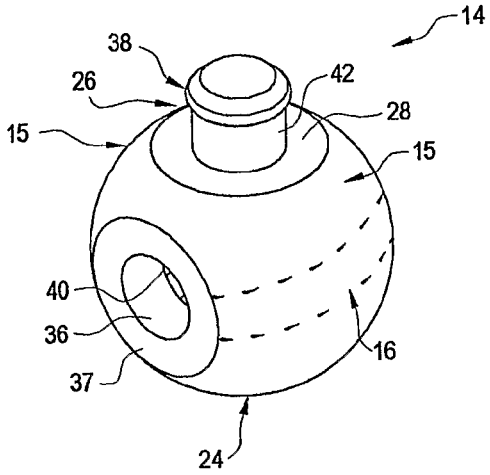
FIG. 2, in a perspective view, illustrates a connector component part of a toy construction system in accordance with an embodiment of the present invention.
Figure 4:
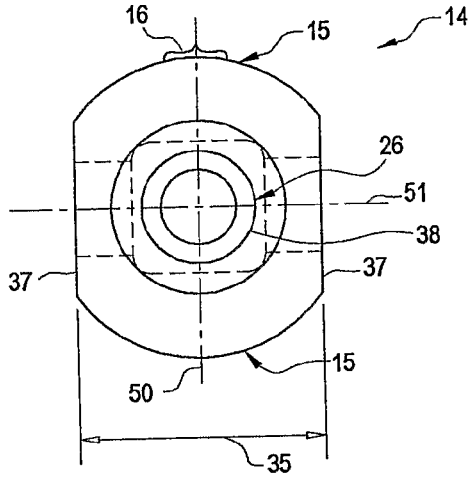
FIG. 4, in a top view, illustrates the connector component shown in FIGS. 2 and 3.
Figure 3:
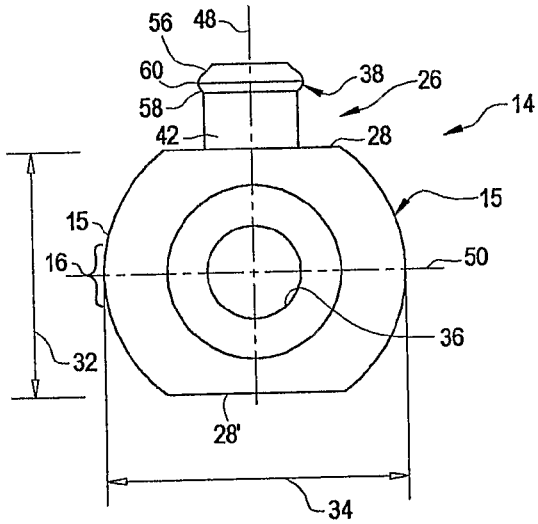
FIG. 3, in an elevational view, illustrates the connector component shown in FIG. 2.

As illustrated more specifically in FIGS. 2 through 4, the connector block contacting surface 16 typically has a truncated or interrupted substantially annular configuration. Typically, the connector block contacting surface 16 is also substantially convex. In the embodiment shown throughout the figures, the connector block contacting surface 16 has a substantially arc-shaped cross-sectional configuration. It should however be understood that the connector block contacting surface 16 could have other configurations without departing from the scope of the present invention.

The block component 12 has a block coupling socket or aperture 18 extending at least partially therethrough. In the embodiment shown throughout the Figures, the block coupling aperture 18 is shown as extending through the block components 12. It should, however, be understood that the block coupling apertures 18 could extend only partially through block components 12 without departing from the scope of the present invention.

Each block coupling aperture 18 has a coupling aperture peripheral edge. The coupling aperture peripheral edge, in turn, defines a peripheral edge retaining section 20 made out of a substantially resiliently deformable material. In the embodiments shown throughout the Figures, the peripheral edge retaining section 20 extends substantially throughout the entire periphery of the coupling aperture peripheral edge. It should, however, be understood that the peripheral edge retaining section 20 could be restricted to only part of the coupling aperture peripheral edge without departing from the scope of the present invention.

The peripheral edge retaining section 20 is typically configured, sized and positioned so that when the block and connector components 12, 14 are in a component assembled configuration relative to each other, the connector block contacting surface 16 deforms at least a portion of the peripheral edge retaining section 20 towards a retaining configuration for positively retaining the latter. The peripheral edge retaining section 20 is also configured, sized and positioned so that when the connector block contacting surface 16 is spaced from at least a portion of the peripheral retaining section 20, the latter resiliently springs back to a non-retaining configuration.

In at least some embodiments of the invention, the block component 12 defines a pair of substantially opposed block main surfaces 22. The block coupling aperture 18 is configured, sized and positioned so that the connector block contacting surface 16 is located between the block main surfaces 22 when the block and connector components are in the component assembled configuration. Typically, the block coupling aperture 18 is configured, sized and positioned so that the connector block contacting surface 16 is located substantially midway between the block main surfaces 22.

As illustrated in FIGS. 2 through 9, each connector component 14 includes a corresponding connector main body 24. In at least some embodiments of the invention illustrated more specifically in FIGS. 2 through 5, the connector-to-connector coupling section includes a connector coupling prong 26 extending substantially outwardly from the connector main body 24.

Figure 17:
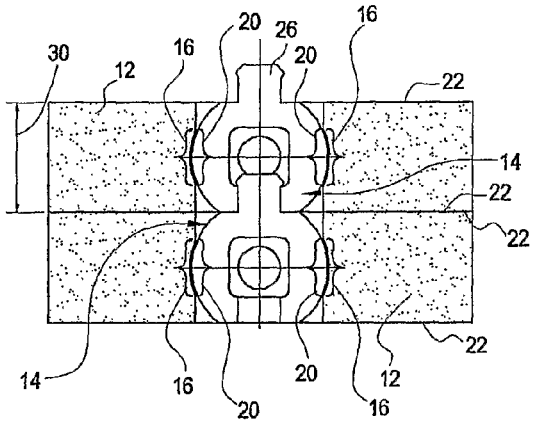
FIG. 17, in a longitudinal cross-sectional view, illustrates a pair of block components assembled together using a corresponding pair of connector components, the block and connector components being part of a toy construction system in accordance with an embodiment of the present invention.
Figure 18:
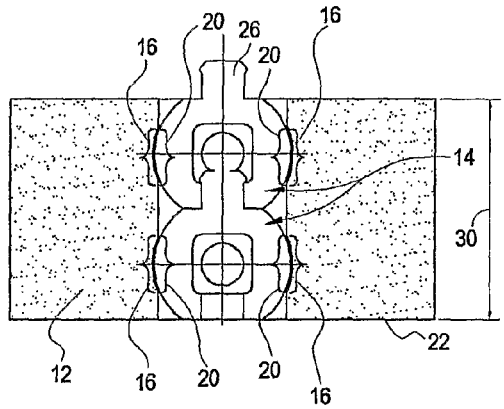
FIG. 18, in a longitudinal cross-sectional view, illustrates a pair of connector components assembled together and inserted in the block coupling aperture of a block component in accordance with an embodiment of the present invention.
Figure 19:
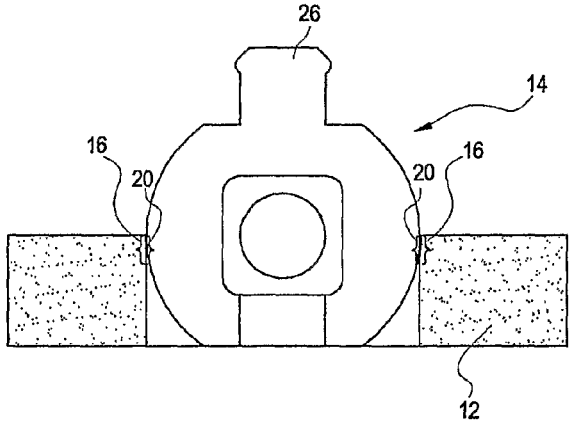
FIG. 19, in a longitudinal cross-sectional view, illustrates an oversized connector component partially inserted in the block coupling aperture of an undersized block component.
Figures 20, 21, 22, 23, 24, 25, 26, 27:
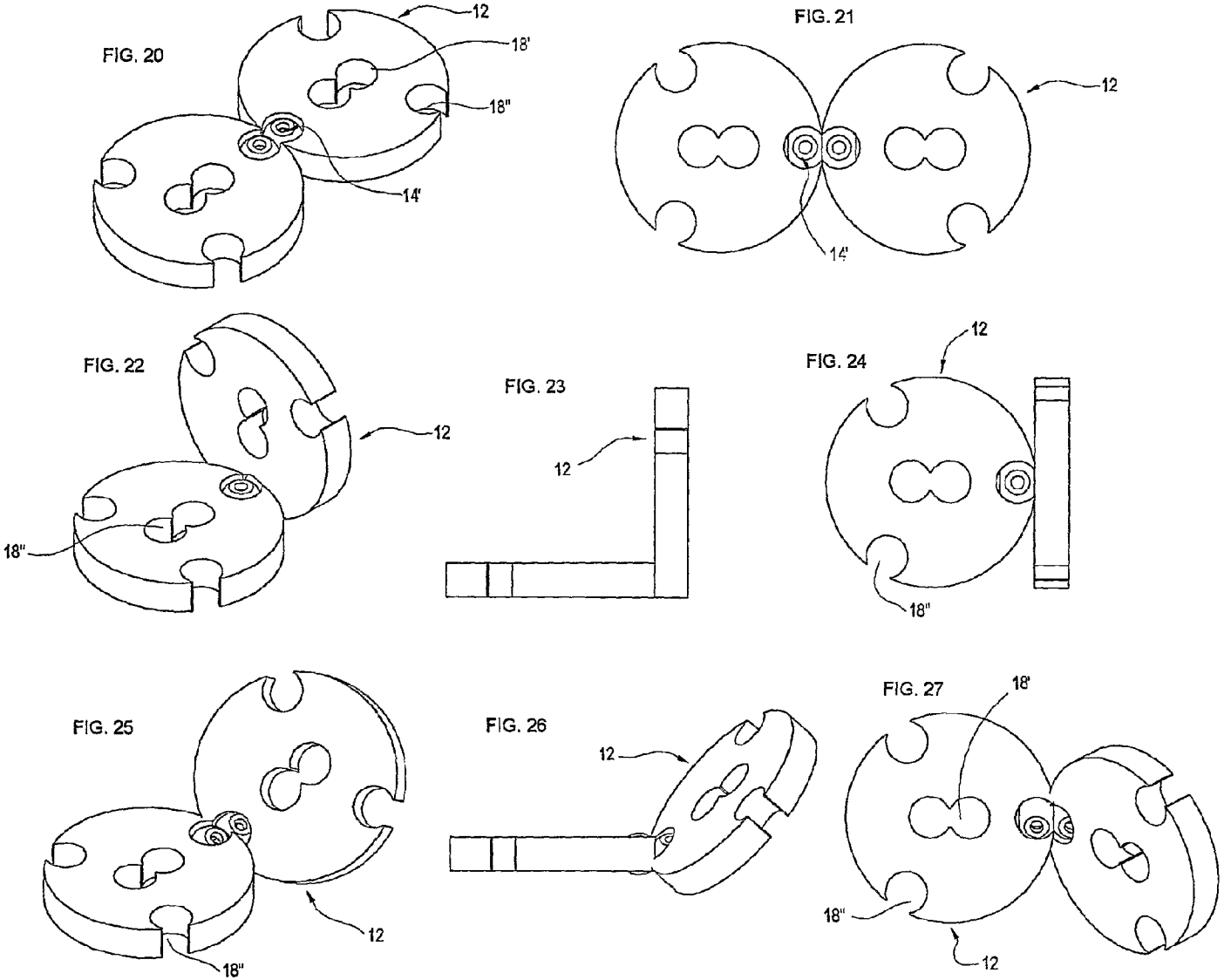
FIG. 20, in a perspective view, illustrates a pair of block components assembled together so as to lie in a substantially common geometrical plane using a double connector component.
FIG. 21, in a top view, illustrates the configuration shown in FIG. 20.
FIG. 22, in a perspective view, illustrates a pair of block components assembled together in a substantially perpendicular relationship relative to each other using a double connector component.
FIG. 23, in an elevational view, illustrates the configuration shown in FIG. 22.
FIG. 24, in a top view, illustrates the configuration shown in FIGS. 22, and 23.
FIG. 25, in a perspective view, illustrates a pair of block components assembled together, the block components being angled relative to each other about two distinct rotation axes.
FIG. 26, in an elevational view, illustrates the configuration shown in FIG. 25.
FIG. 27, in a top view, illustrates the configuration shown in FIG. 26
Figures 28, 29, 30, 31, 32, 33, 34, 35, 36:
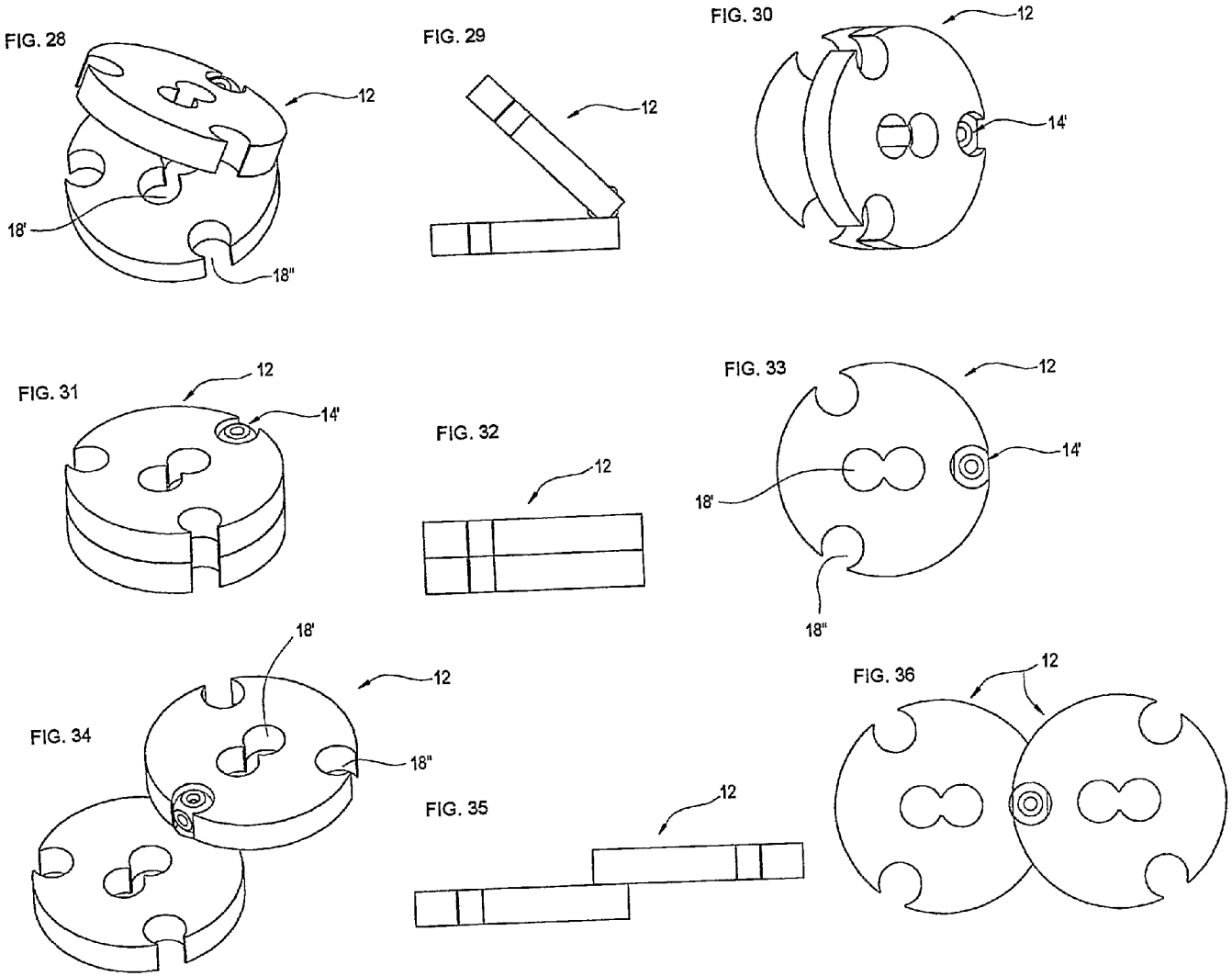
FIG. 28, in a perspective view, illustrates a pair of block components assembled together in an angled relationship relative to each other so as to form a substantially jaw-like configuration using a double connector component FIG. 29, in an elevational view, illustrates the configuration shown in FIG. 28.
FIG. 30, in a top view, illustrates the configuration shown in FIGS. 28 and 29.
FIG. 31, in a perspective view, illustrates a pair of block components assembled together in a stacked relationship relative to each other using a double connector component.
FIG. 32, in an elevational view, illustrates the configuration shown in FIG. 31.
FIG. 33, in a top view, illustrates the configuration shown in FIGS. 31 and 32.
FIG. 34, in a perspective view, illustrates a pair of block components assembled together in a cantilevered-type configuration using a double connector component.
FIG. 35, in a partial elevational view with sections taken out, illustrates the configuration shown in FIG. 34.
FIG. 36, in a top view, illustrates the configuration shown in FIGS. 34 and 35.
Figure 37:
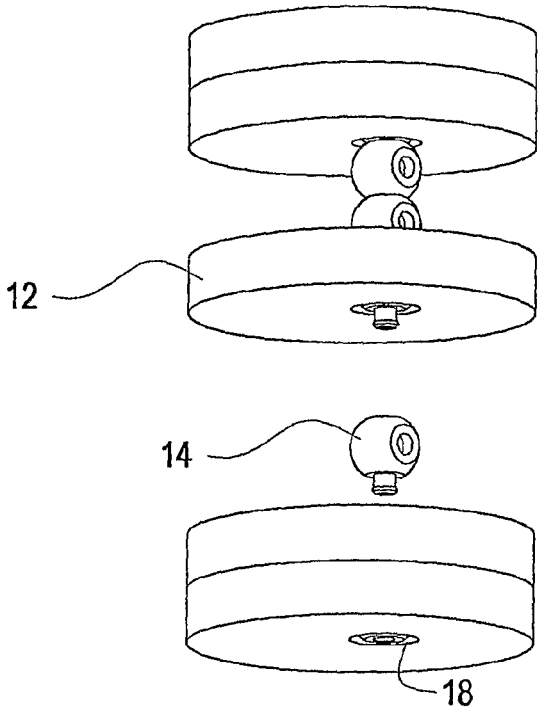
FIG. 37, in a perspective exploded view, illustrates block components about to be assembled together with some block components in an adjacent relationship relative to other, while other block components are in spaced relationship relative to others, the block components being assembled using connector components also part of the present invention.
Figure 38:
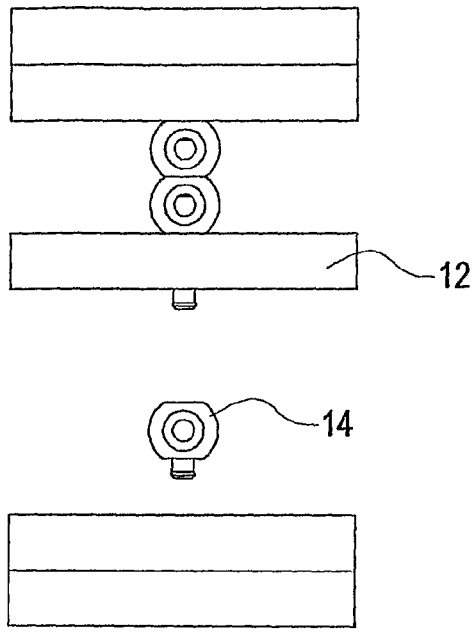
FIG. 38, in an elevational view, illustrates the configuration shown in FIG. 37.

As shown in FIGS. 17 and 18, the block coupling aperture 18 is typically configured and sized for receiving a discreet number of connecting components 14 therein so that only a single connecting coupling prong 26 protrudes from the block coupling aperture 18 when the discreet number of connecting components 14 are inserted therein. FIG. 17 illustrates a situation wherein the discreet number is one, while FIG. 18 illustrates a situation wherein the discreet number is two. It should be understood that any suitable discreet number could be used without departing from the scope of the present invention.

As illustrated more specifically in FIGS. 2 through 5, the connector main body 24 typically has a truncated substantially spherical configuration. The connector main body 24 typically defines at least one substantially flat truncation surface 28 extending substantially radially from the base of the coupling prong 26 in a substantially perpendicular relationship relative to the latter. Typically, the connector main body 24 also includes a second truncation surface 28' located in a substantially diametrically opposed relationship relative to the first truncation surface 28.

As indicated in FIG. 17, typically, the block main surfaces 22 are spaced relative to each other by a main surface spacing distance 30. Similarly, as indicated in FIG. 3, the truncation surfaces 28, 28' are typically spaced relative to each other by a truncation surface distance 32. Preferably, the main surface spacing distance 30 is substantially equal to a predetermined discreet number of truncation surfaces spacing distances 32.

As shown in FIG. 3, the coupling prong 26 defines a prong longitudinal axis 48. The prong longitudinal axis 48 extends in a substantially perpendicular relationship relative to the first and second truncation surfaces 28, 28'. The first and second truncation surfaces 28, 28' are typically in a substantially symmetrically disposed relationship relative to a main body main axis 50.

Preferably, the connector-to-connector coupling section includes at least one connector coupling aperture 36 formed in the connector main body 24. Each connector coupling aperture 36 is configured, sized and positioned so as to releasably secure at least a portion of the connecting prong 38 of a substantially similar connector component 14.

In order to facilitate manufacturing of the connector components 14 by an injection moulding process, the connector main body 24 is typically truncated adjacent the connector coupling aperture 36 hence defining a corresponding aperture truncation surface 37.

Typically, each connector component 14 includes three corresponding connector coupling apertures 36. A first one of said connector coupling apertures 36 is typically positioned in a substantially diametrically opposed relationship relative to the coupling prong 26. The aperture truncation surface 37 of this first coupling aperture 36 typically corresponds to the second truncation surface 28'.

The other two connector coupling apertures 36 are typically positioned in a substantially diametrically opposed relationship relative to each other along a coupling aperture axis 51 perpendicular to both the prong longitudinal axis 48 and the main body main axis 50. The pair of opposed connector coupling apertures 36 are typically substantially symmetrically disposed between the other connector coupling aperture 36 and the coupling prong 26.

The connector main body 24 typically has substantially the configuration of a sphere truncated by substantially diametrically opposed first and second truncation surfaces 28, 28' and by the substantially diametrically opposed aperture truncation surfaces 37 of connector coupling apertures 36 located in along the coupling aperture axis 51. The connector main body 24 hence typically defines a pair of substantially diametrically opposed sphere sections 15. Typically, the connector block contacting surface 16 includes an annular portion of the sphere sections 15 located substantially adjacent the apex thereof As illustrated in FIG. 3, the connector main body 24 defines a connector coupling diameter 34 located about the main body main axis 50. As illustrated in FIG. 4, the aperture truncation surfaces 37 of connector coupling apertures 36 located in along the coupling aperture axis 51 define a coupling aperture spacing 35 therebetween.

Typically, although be no means exclusively, the coupling diameter 34 has a value of about 16 mm. Typically, although by no means exclusively, the coupling aperture spacing 35 has a value of about 13 mm. Typically, although by no means exclusively, the truncation surface distance 32 has a value of about 13 mm. Typically, the block coupling aperture 18 has a diameters of about between 13 and 14.5 mm. It should however be understood that the block coupling aperture 18 the coupling diameter 34, the coupling aperture spacing 35 and the truncation surface distance 32 could have other values without departing from the scope of the present invention.

Each coupling prong 26 is typically provided with a corresponding locking flange 38 located substantially adjacent a distal tip thereof. Each connector coupling aperture 36 defines an inner rim 40 for abuttingly contacting the locking flange 38. The coupling prong 26 is configured and sized so that the locking flange 38 abuttingly contacts the inner rim 40 when the coupling prong 26 of a first connector component 14 is inserted in the connector coupling aperture 36 of a similar second coupling component 14. The contact between the coupling prong 26 of the first connector component 14 the inner rim 40 of a similar second coupling component 14 allows for releasable coupling and locking of the first and second coupling components 14 together in a connector component coupled configuration.

Typically, the coupling prong 26 and the connector coupling aperture 36 both have a substantially cylindrical configuration and a substantially disc-shaped cross-sectional configuration so that rotation of the coupling prong 26 within the connector coupling aperture 36 is allowed and, hence, the first and second coupling components 14 are allowed to pivot relative to each other. Alternatively, the coupling prong 26 and the connector coupling aperture 36 could be configured and sized so as to prevent rotation of the first and second coupling components 14 relative to each other when in the connector component coupled configuration.

Typically, each coupling prong 26 defines a corresponding prong stem 42 having a predetermined stem length and stem width. Each locking flange 38 extends substantially radially from the peripheral edge of a corresponding prong stem 42. Each connector coupling aperture 36 is configured and sized so as to substantially and fittingly receive a corresponding prong stem 42.

Each coupling prong 26 is typically provided with a substantially resilient prong diameter adjustment means for allowing the resilient deformation of the coupling prong 26 so as to allow passage of the locking flange 38 when the locking prong 26 is being inserted in the connector coupling aperture 36 of a similar coupling component 14. The prong diameter adjustment means may take any suitable form such as that of a coupling prong 26 made out of a substantially resilient material. In an alternative embodiment of the invention (not shown) the prong diameter adjustment means includes a substantially central prong channel extending longitudinally substantially therealong and a prong slot extending substantially longitudinally in the peripheral wall formed by the coupling prong 26.

Typically, in order to facilitate the passage of the locking flange 38 when the coupling prong 26 is being inserted in the connector coupling aperture 36 of a similar coupling component 14, the connector body of the prong receiving coupling component 14 is made out of a material allowing the connector coupling aperture 36 to also resiliently change its configuration and/or size.

Figure 5:
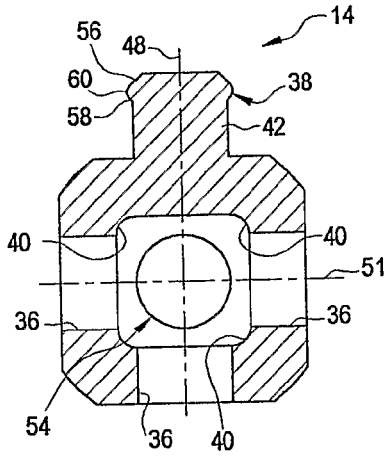
FIG. 5, in a longitudinal cross-sectional view, illustrates some of the features of the connector component shown in FIGS. 2 through 4.
Figure 6:
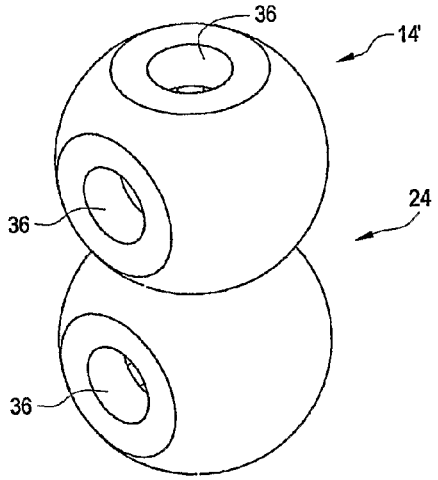
FIG. 6, in a perspective view, illustrates a double connector component part of a toy construction system in accordance with an embodiment of the present invention.
Figure 8:
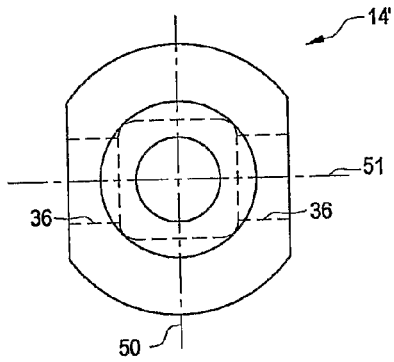
FIG. 8, in a top view, illustrates the double connector component shown in FIGS. 6 and 7.
Figure 7:
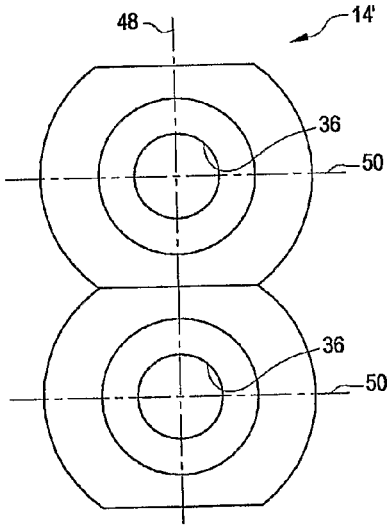
FIG. 7, in an elevational view, illustrates the double connector component shown in FIG. 6.

As shown more specifically in FIG. 5, each connector coupling aperture 36 defines a corresponding peripheral inner rim 40. As illustrated more specifically in FIG. 10, each connector main body 24 also typically includes substantially centrally disposed main body cavity 54 for substantially fittingly receiving the locking flanges 38 of substantially similar connector components 14 releasably attached to the three connector coupling apertures 36.

As illustrated more specifically in FIGS. 3 and 5, and 10 through 12, each locking flange 38 typically defines a substantially annular flange distal surface 56 merging at a flange apex 60 with a substantially annular flange proximal surface 58. The flange distal and proximal surfaces 56, 58 typically extend at an angle relative to each other so as to define the flange apex 60. Typically, the flange distal surface 56 is adapted to facilitate insertion of the flange in a corresponding connector coupling aperture 36 while the flange proximal surface 58 is adapted to abuttingly and lockingly contact the locking rim 40.

Figure 10:
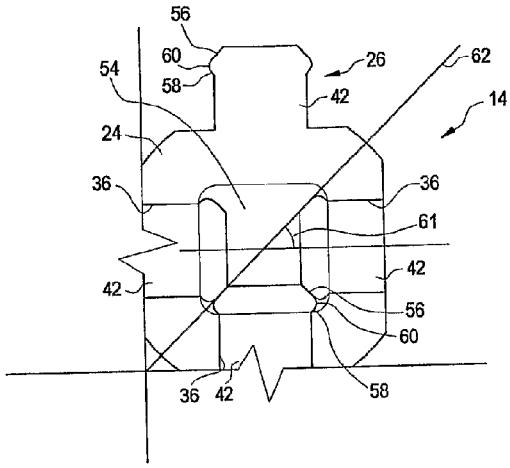
FIG. 10, in a partial cross-sectional view with sections taken out, illustrates the relationship between the connector coupling apertures of a connector component and the coupling prongs of similar coupling components when the latter are attached together in a connector assembled configuration.

As illustrated more specifically in FIG. 10, the flange distal surface 56 typically extends at a distal surface angle 60 relative to the corresponding prong longitudinal axis 48. Typically, the distal surface angle 61 has a value substantially in the range of 45 degrees. As illustrated more specifically in FIGS. 10 through 12, the main body main cavity 54 typically has a substantially cubic configuration with rounded edges.

As illustrated in FIG. 10, in order to prevent the interference between coupling prongs 26 and/or their associated locking flanges 38 when more than one locking flange 38 is inserted in the main body main cavity 54, the length and diameter of the coupling prongs 26 and, hence, of the connector coupling apertures 36 are limited by a 45 degrees reference plane 62.

Figure 12:
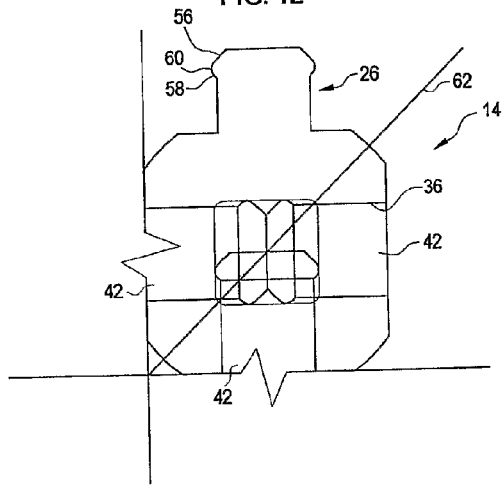
FIG. 12, in a partial longitudinal cross-sectional view with sections taken out, illustrates the relationship between connector coupling apertures of a connector component and the coupling prongs of similar coupling components when the latter are attached together in situations wherein the coupling prongs are oversized relative to the connector component.
Figure 11:
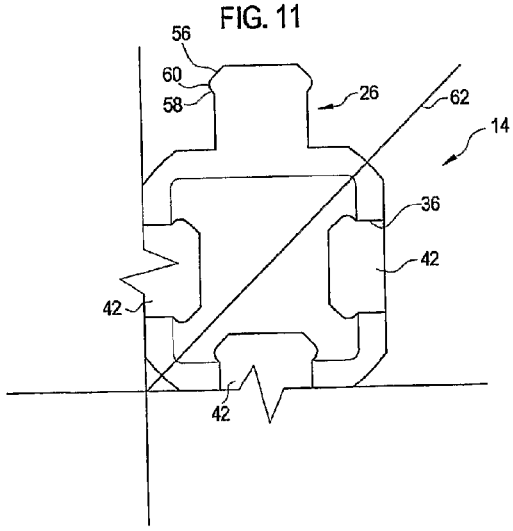
FIG. 11, in a partial longitudinal cross-sectional view with sections taken out, illustrates the relationship between connector coupling apertures of a connector component and the coupling prongs of similar coupling components when the latter are attached together in situations wherein the coupling prongs are undersized relative to the connector component.

FIG. 12 illustrates a situation wherein the coupling prongs 26 are oversized and, hence, extend beyond the reference plane 62 causing the coupling prongs 26 to interfere with each other. FIG. 11 illustrates a situation wherein the coupling prongs 26 are undersized hence failing to reach the reference plane 62. In such instances, the undercut of the main body main cavity 54 is typically too large to allow moulding of the connector components 14.

Although various dimensions may be used to ensure the presence of a 45 degrees reference plane 62, the configuration and size of the various sections of the connector component 14 are typically optimised in order to minimise truncation of the sphere formed by the connector main body 24 while precluding dimensions so small that they would be too weak for supporting the forces applied on the connector component 14 during use thereof. In other words, after taking into consideration the possible interference between the locking flanges 38 of the coupling prongs 26 when inserted into the main body main cavity 54, the remainder of the dimensional parameters of the connector component 14 are typically sized so as to minimise truncation of the connector main body 24 and so as to reduce the risks of structurally weakening the latter.

Referring now more specifically to FIGS. 6 through 9, there is shown a connector component 14' typically also used with a toy construction system 10 in accordance with the present invention. The connector component 14' is substantially similar to the connector component 14 and, hence, similar reference numerals will be used to denote similar components.

One of the main differences between the connector components 14 and 14' resides in that the connector main body 24' of the connector component 14' has the general configuration of a pair of truncated spheres extending integrally from each other about a common truncation plane. Also, the main body main cavity 54' has a substantially parallelepiped-shaped configuration instead of a substantially cubic configuration. Furthermore, the connector component 14', also commonly referred to as a double connector component 14', is provided with six connector coupling apertures 36 instead of three. Still furthermore, the double connector component 14' is typically deprived of a coupling prong 26.

Figure 13:
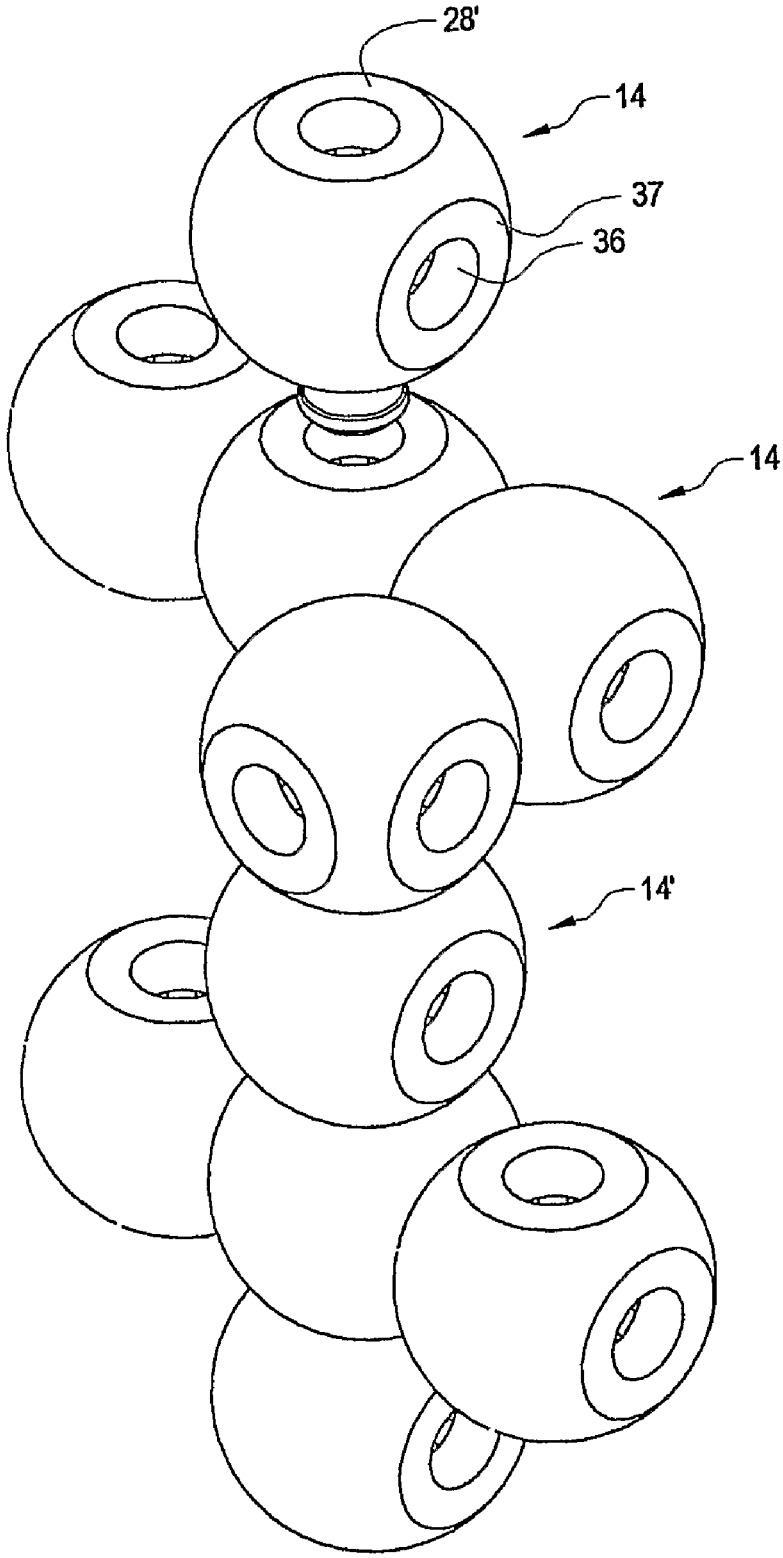
FIG. 13, in a perspective view, illustrates connector components parts of a toy construction system in accordance with an embodiment of the present invention being assembled together in a three-dimensional configuration.
Figure 14:
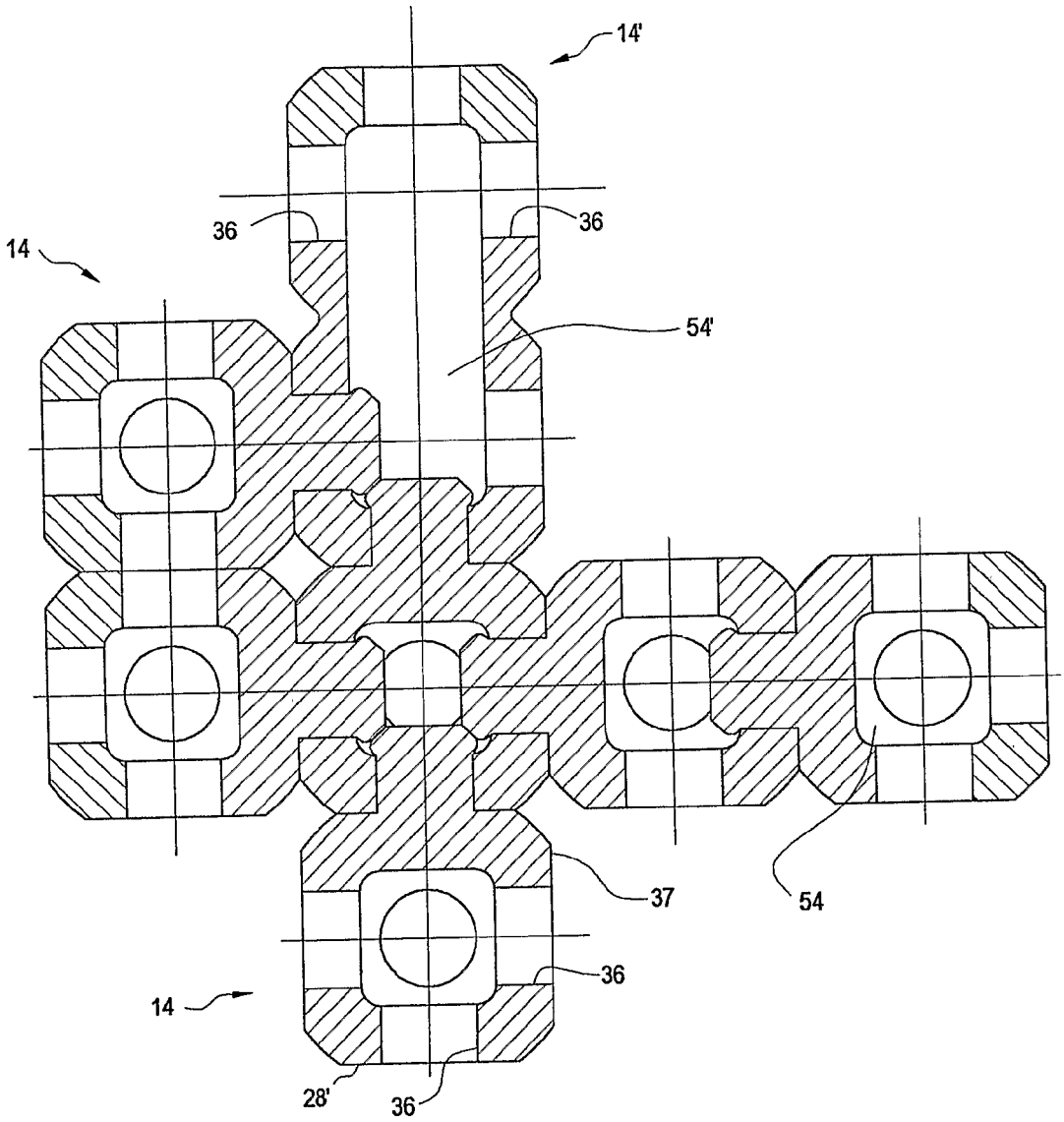
FIG. 14, in a cross-sectional view illustrates a plurality of connector components in a connector assembled configuration.

FIGS. 13 and 14 illustrate, by way of example, typical assemblies formed by connector components 14 and 14' assembled together so as to form a substantially three-dimensional structure.

FIGS. 15*a* through 15*l* and 16*a* through 16*l* illustrate various configurations of block components 12. FIGS. 15*a*, 15*d*, 15*g* and 15*j* illustrate, by way of example, various configurations wherein the block components 12 are provided with a single block coupling aperture 18. FIGS. 15*b*, 15*e*, 15*h* and 15*k* illustrate, by way of example, various configurations wherein the block components 12 are provided with a so-called block double coupling aperture 18' wherein a pair of coupling apertures 18 intersect each other so as to form a generally "8"-shaped coupling aperture 18'. FIGS. 15*c*, 15*f*, 15*i* and 15*l* illustrate, by way of example, various configurations wherein the block components 12 are provided both with a block double coupling aperture 18' and at least one block coupling aperture 18.

FIGS. 16*a* through 16*i*, illustrate, by way of example, configurations wherein the block components 12 are provided with the same type of block coupling apertures 18, 18' as corresponding FIGS. 15*a* through 15*i*. However, the block components 12 shown in FIG. 16*a* through 16*i* are further provided with at least one block peripheral coupling aperture 18" intersecting the peripheral edge of a corresponding block component 12.

Figure 16:
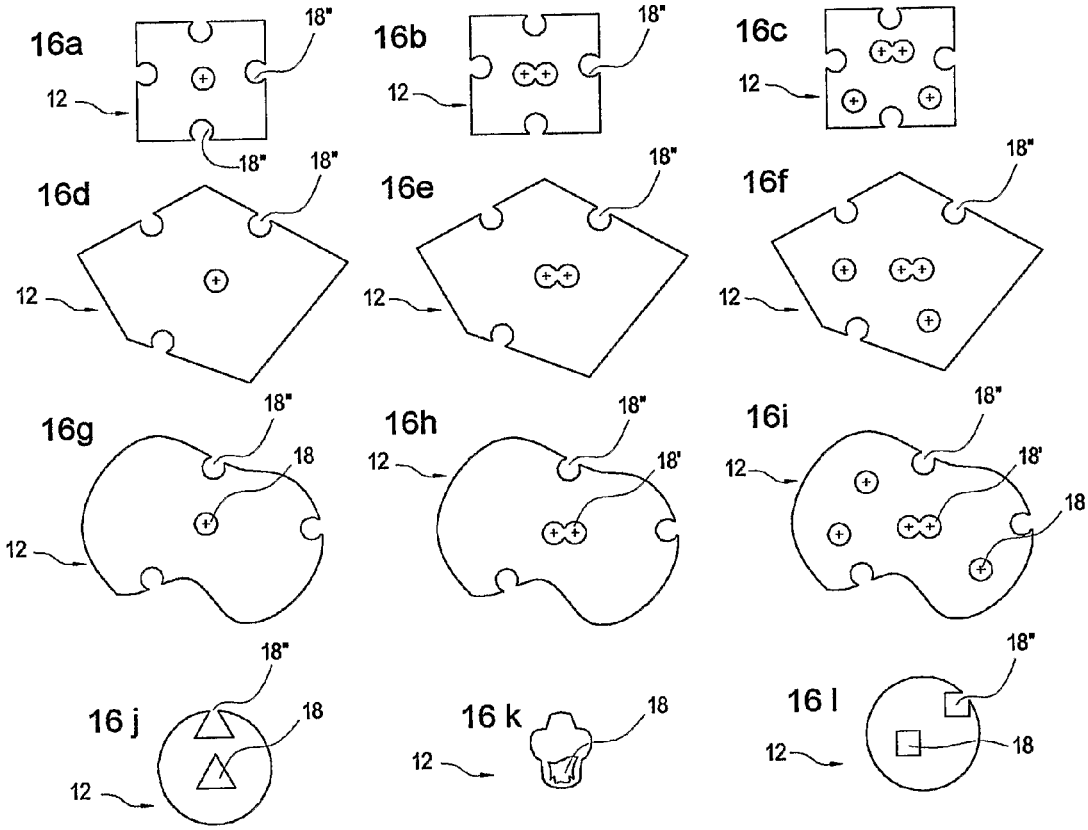
FIGS. 16*a* through 16*l*, in top views, illustrate various configurations of block components part of a toy construction system in accordance with an embodiment of the present invention, the block components being provided with block coupling apertures extending therethrough, some of the block coupling apertures being positioned inside the perimeter of the block component while other block coupling apertures intersecting the block component outer peripheral edge.

Although the block coupling apertures 18, 18' and 18" shown throughout most figures are shown as having a substantially disk-shaped configuration, it should be understood that the block coupling apertures could have other configurations without departing from the scope of the present invention. For example, FIGS. 16*j* through 16*l* illustrate block coupling apertures 18 and 18" having respectively generally triangular, complex and square configurations.

Figure 39:
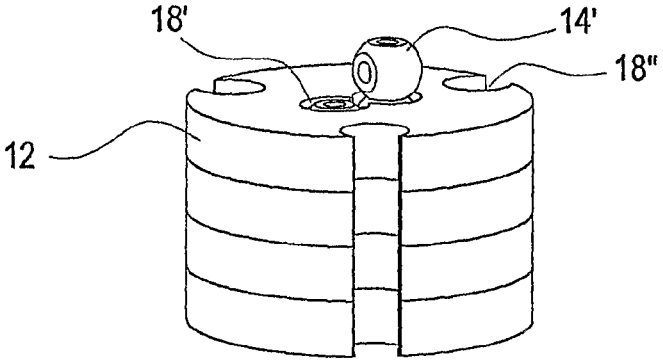
FIG. 39, in a perspective view, illustrates a set of block components having double block coupling apertures assembled together using double connector components positioned in an offset relationship relative to each other.
Figure 40:
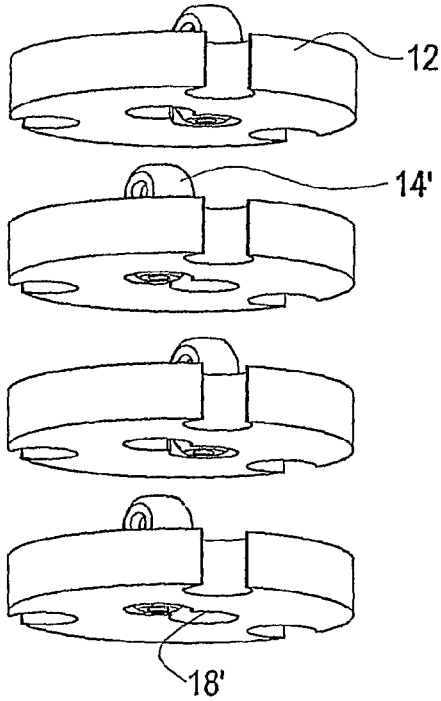
FIG. 40, in an exploded view, illustrates the configuration shown in FIG. 39.

Furthermore, the peripheral edge of the block coupling apertures 18, 18' and 18" could be serrated or provided with other types of irregularities or discontinuities without departing from the scope of the present invention. Also, although the block coupling apertures 18, 18' and 18" are shown as having a substantially constant cross-sectional configuration, block apertures having varying cross-sectional configurations could be used without departing from the scope of the present invention. Still furthermore, a given block components may be provided with various block coupling apertures 18, 18' and/or 18" having different configurations without departing from the scope of the present invention When double connector components 14' are used with block components having block double coupling apertures 18', the block components 12 may be superposed in a particular manner on top of each other. As shown in FIGS. 39 and 40, the block double coupling aperture 18' allows the use of two independent double connector components 14' and, hence, allows block components 12 to be stacked or superposed on top of each other without having the double connector components 14' linked together. With such an arrangement, each stacked block component 12 is able to move independently.

Figure 41:
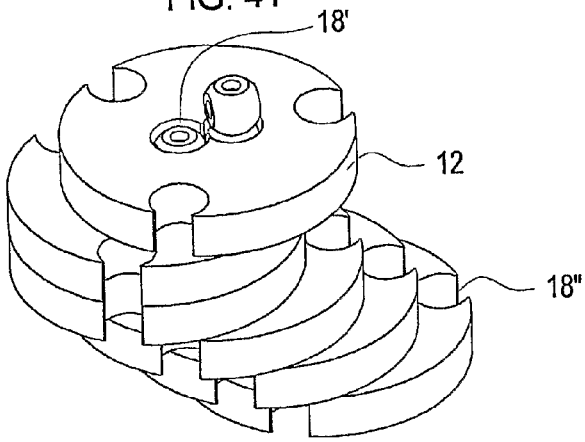
FIG. 41, in a perspective view, illustrates the block components shown in FIGS. 39 and 40 being offset relative to each other by the rotation of the block components about the double connector components.
Figure 42:
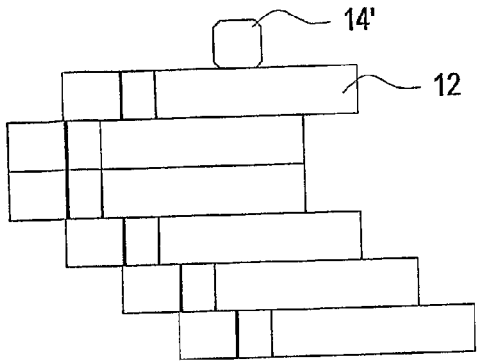
FIG. 42, an elevational view, illustrates the configuration shown in FIG. 41.
Figure 43:
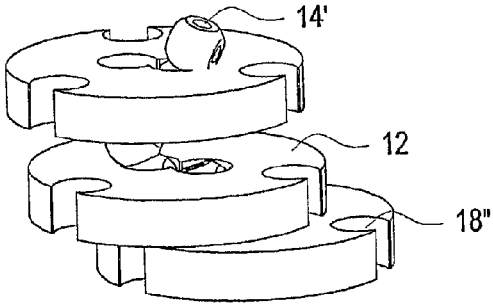
FIG. 43, in a partial exploded view, illustrates the block components shown in FIGS. 39 through 42 being offset relative to each other by angularly displacing the double connector components relative to the block components.
Figure 44:
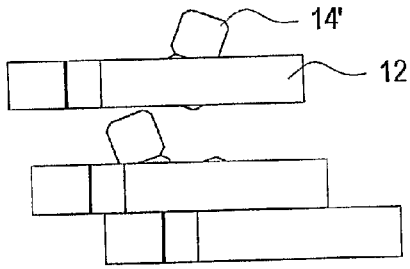
FIG. 44, in an elevational view, illustrates the configuration shown in FIG. 43.

Offsetting of the block components 12 relative to each other may be obtained either by rotation of the block components 12 about the eccentric assembly axis of the double connector 14' as shown in FIGS. 41 and 42 or by angularly displacing the connector component 14' within the block double coupling aperture 18'. Both methods may be combined to further increase the offsetting between adjacent block components 12. Furthermore, the offsetting values or angles may be varied at each level since the double connector components 14' are independent relative to each other.

Figure 45:
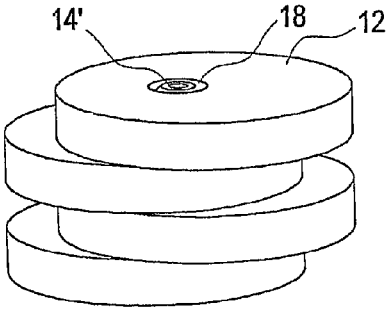
FIG. 45, in a perspective view, illustrates a set of block components having a single block coupling aperture, the single block coupling aperture being symmetrically positioned or offset relative to the peripheral edge of the block component, the block components being offset relative to each other by rotation of the block component about the connector components.
Figure 46:
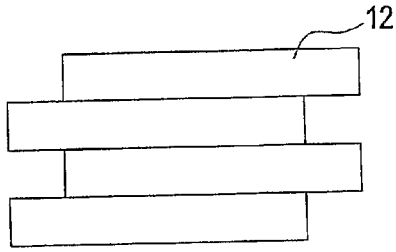
FIG. 46, in an elevational view, illustrates the configuration shown in FIG. 45.

By contrast, FIGS. 45 and 46 illustrate a situation wherein block components 12 are superposed using a single offset block coupling aperture 18. In such situations, offsetting by rotation of the block components 12 is possible but may not be accumulated at each level since there exists only one axis of rotation. Offsetting by angular displacement is impossible and variation of the offsetting angles at each level is also impossible since the connector components 14' are linked together.

Figure 47:
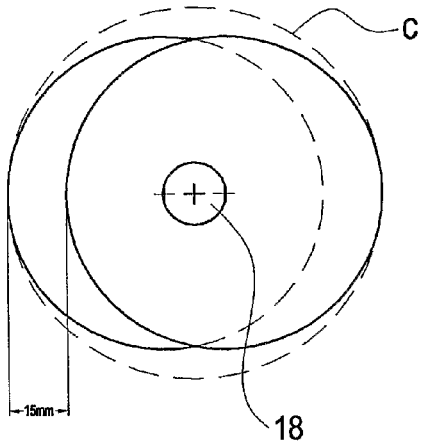
FIG. 47, in a top view, illustrates the offsetting distance provided by pivoting block components having a single offset block coupling aperture.
Figure 48:
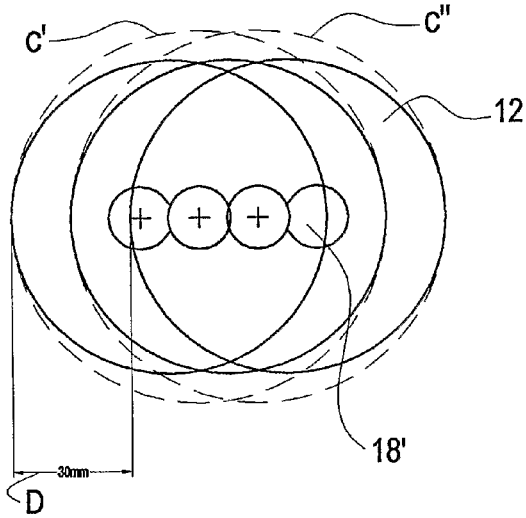
FIG. 48, illustrates the offsetting distance provided by pivoting block components having a double block coupling aperture.

FIG. 47 illustrates an optimal offsetting circle C corresponding to the greatest possible offsetting at each level when block components 12 having a single yet offset block coupling aperture 18 are used. By contrast, FIG. 48 defines a first offsetting circle C' and a second offsetting circle C" respectively illustrating the greatest offset possible at a first and a second level respectively when block components 12 having corresponding block double coupling apertures 18' are used. As shown by the distance D in FIG. 48, the offsetting distance between levels is cumulative due to the presence of the block double coupling apertures 18'.

The block component 12 may be provided with a variety of surface textures, corrugations, serrations and the like. The block component 12 is typically made out of foam or a substantially resilient polymeric and/or elastomeric resin. In at least one embodiment of the invention, the preferred resin is an ethyl-vinyl-acetate resin (EVA foam).

By being substantially resilient, the block component 12 is adapted to receive asymmetrical connector components 14, 14' without altering the function of the latter. The connector components 14, 14' are also allowed to pivot in a variety of positions.

Furthermore, friction therebetween is reduced. Also, the relatively low density of the resilient foam allows for the construction of relatively lightweight structures. Furthermore, the substantially soft and resilient nature of the resin preferably used eliminates potentially dangerous hard edges.

The connector components 14, 14' are typically made out of a suitable elastomeric and/or polymeric resin. In at least one embodiment of the invention, the connector components 14, 14' are made out of a thermoplastic elastomeric resin, Typically, although by no means exclusively, the connector components 14, 14' have a hardness substantially smaller than 95 on the shore A. The block and connector components 12, 14 are adapted to be coloured using conventional colouring pigments for enhancing their attractiveness and visual appeal.

The substantially spherical configuration and connecting capability of the connector components 14 allow the latter to cumulate at least three distinct functions. Indeed, connector components 14 may be used as multidirectional joints between block components 12. They may also be used as superposing joints for connecting block components 12 to each other with or without spacing therebetween. They are still further adapted to be used as a decorative or figurative component, for example, for creating eyes, legs or the like as shown in FIGS. 1*a* through 1*d*.

Figure 9:
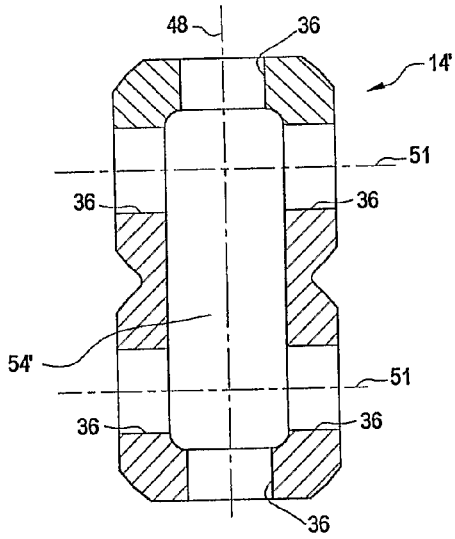
FIG. 9, in a longitudinal cross-sectional view, illustrates some of the features of the double connector component shown in FIGS. 6 through 8.
Figure 9A:
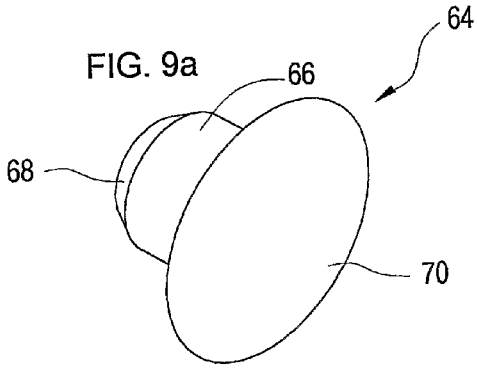
FIG. 9*a*, in a perspective view, illustrates a cap component part of a toy construction system in accordance with an embodiment of the present invention.
Figure 9B:
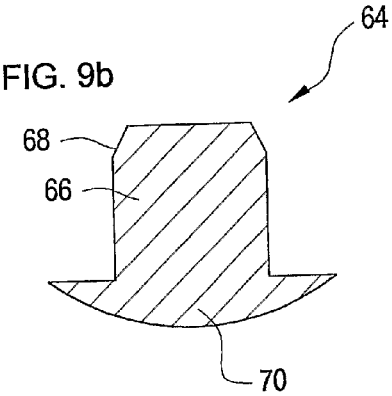
FIG. 9*b*, in a cross-sectional view, illustrates the cap component shown in FIG. 9*a;*

FIGS. 9*a* and 9*b* illustrate a cap component 64 adapted to be also used as a decorative or figurative component. The cap component 64 includes a cap stem 66 configured and sized for being substantially fittingly insertable into corresponding connector coupling apertures 36 suitable receress or aperture so as to block coupling apertures 18, 18' and/or 18" or other be frictionally releasably retained therein. The cap stem is typically provided with a cap stem tapered section 68 adjacent a distal tip thereof. Each cap component 64 also includes a corresponding cap protruding section 70 for protruding outwardly from the corresponding connector coupling apertures 36 or block coupling apertures 18, 18' and/or 18" into which the cap stem 66 is inserted. In the embodiment illustrated in the Figs, the cap protruding section has a substantially convex disc-shaped configuration. It should however be understood that the cap protruding section could have other configurations without departing from the scope of the present invention. Also, the cap protruding section could be provided with ornamentation without departing from the scope of the present invention.

Figure 9C:
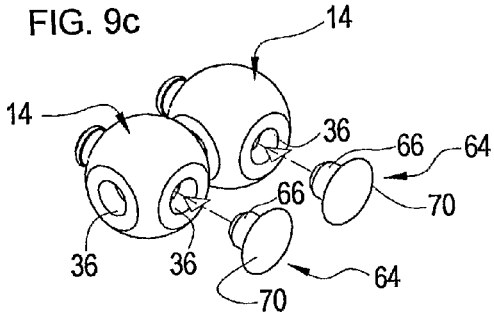
FIG. 9*c*, in an exploded view illustrates a pair of cap components such as shown in FIGS. 9*a* and 9*b* about to be assembled to a corresponding pair of connector components for simulating the eyes of an animal.
Figure 9D:
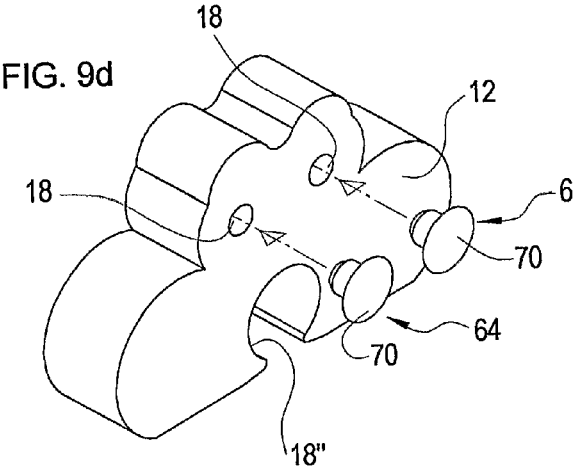
FIG. 9*d*, in an exploded view illustrates a pair of cap components such as shown in FIGS. 9*a* and 9*b* about to be assembled to a block component for simulating the eyes of an animal.

FIG. 9*c*, in an exploded view illustrates a pair of cap components 64 about to be assembled to a corresponding pair of connector components 14 for simulating the eyes of an animal. FIG. 9*d*, in an exploded view illustrates a pair of cap components 64 about to be assembled to a block component 12 for simulating the eyes of an animal.

Figure 9E:
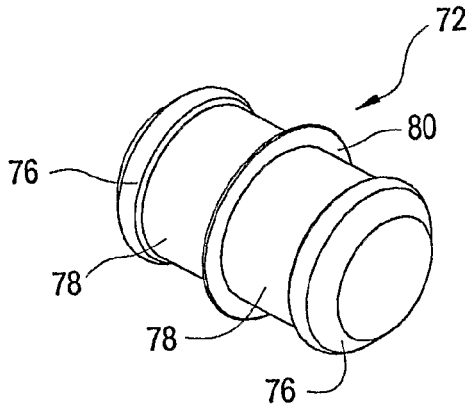
FIG. 9*e*, in a perspective view, illustrates a connecting rod part of a toy construction system in accordance with an embodiment of the present invention.
Figure 9F:
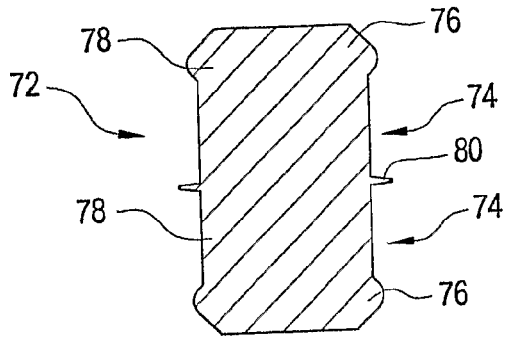
FIG. 9*f*, in a cross-sectional view, illustrates the connecting rod shown in FIG. 9*e;*

FIGS. 9*e* and 9*f* illustrate respectively in perspective and cross-sectional views a connecting rod 72 also part of a toy construction system in accordance with an embodiment of the present invention. Each connecting rod 72 includes a pair of rod prong sections 74 extending in a substantially collinear yet opposite direction relative to each other. The rod prong sections 74 are typically substantially similar to the coupling prong 26 and are hence typically provided with a corresponding connecting rod locking flange 76 located substantially adjacent a distal tip thereof.

Also, similarly, each rod prong section 74 defines a corresponding rod prong stem 78 having a predetermined stem length and stem width. Each connecting rod locking flange 76 extends substantially radially from the peripheral edge of a corresponding rod prong stem 78. The rod prong stems 78 are typically configured and sized for being substantially fittingly insertable into corresponding connector coupling apertures 36 for releasably coupling a pair of connector components 14 together.

Each rod prong section 74 is typically provided with a substantially resilient prong diameter adjustment means for allowing the resilient deformation of the rod prong section 74 so as to allow passage of the connecting rod locking flange 76 when the rod prong section 74 is being inserted in a connector coupling aperture 36.

Figure 9G:
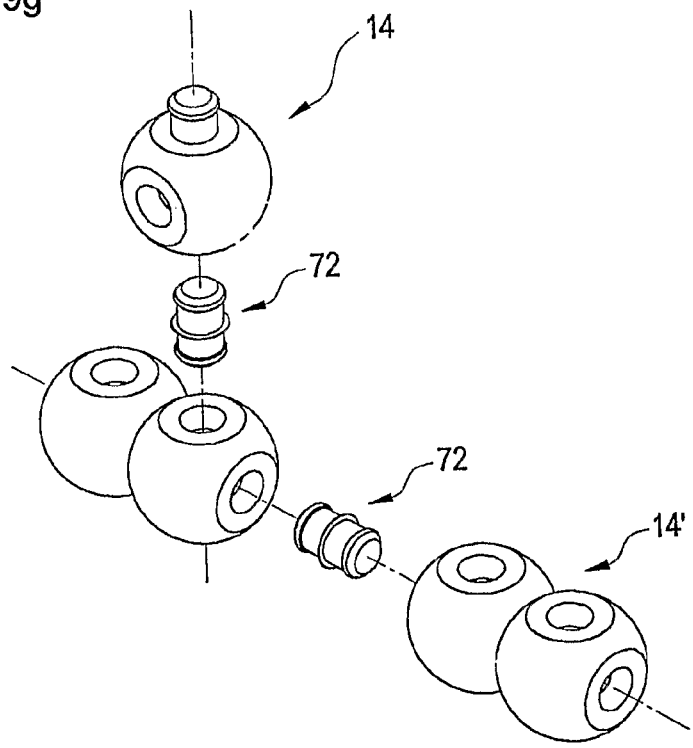
FIG. 9*g*, in an exploded view illustrates a pair of connecting rods such as shown in FIGS. 9*e* and 9*f* about to be assembled to a corresponding set of connector components for connecting the latter.

Typically, a rod flange 80 extends radially outwardly from the connecting rod 72 intermediate the rod prong sections 74. Typically, the rod prong sections are made out of a resiliently bendable material. FIG. 9*g*, in an exploded view illustrates a pair of connecting rods 72 each about to be assembled to a corresponding set of connector components 14 for connecting the latter.

I claim:

1. A toy construction system comprising: a block component, and at least two substantially similar connector components; said connector components having each a connector-to-block coupling section for releasable coupling to said block component and a connector-to-connector coupling section for releasable coupling to another one of said connector components; said connector-to-block coupling section defining a connector block contacting surface for contacting said block component; said block component having a block coupling aperture extending at least partially therethrough, said block coupling aperture having a coupling aperture peripheral edge; said coupling aperture peripheral edge defining a peripheral edge retaining section made out of a substantially resiliently deformable material, said peripheral edge retaining section being configured, sized and positioned so that when any one of said connector components and said block component are in a component assembled configuration relative to each other, said connector block contacting surface substantially deforms at least a portion of said peripheral edge retaining section to a retaining configuration for positively retaining the latter; and when said connector block contacting surface is spaced from said at least a portion of said peripheral edge retaining section, the latter resiliently springs back to a non-retaining configuration; said connector component including a connector main body; said connector-to-connector coupling section including a connector coupling prong extending substantially outwardly from said connector main body; said block coupling aperture being configured and sized for receiving a discreet number of connecting components therein so that that only a single connector coupling prong protrudes from said block coupling aperture when said discreet number of connecting components are inserted therein, said discreet number being two.

2. A toy construction system as recited in claim 1, wherein said connector block contacting surface has a substantially annular configuration.

3. A toy construction system as recited in claim 2, wherein said connector block contacting surface has a substantially convex configuration.

4. A toy construction system as recited in claim 3, wherein said connector block contacting surface has a substantially arc-shape configuration.

5. A toy construction system as recited in claim 1, wherein said block component defines a pair of substantially opposed block main surfaces, said block coupling aperture being configured, sized and positioned so that said connector block contacting surface is located between said block main surfaces when said block and said any one of said first connector components are in said component assembled configuration.

6. A toy construction system as recited in claim 5, wherein said block coupling aperture is configured, sized and positioned so that said connector block contacting surface is located substantially centrally between said block main surfaces when said block and connector components are in said component assembled configuration.

7. A toy construction system as recited in claim 1, wherein said connector main body has a truncated substantially spherical configuration, said connector main body defining at least one substantially flat truncation surface extending substantially adjacent the base of said coupling prong in a substantially perpendicular relationship relative to the latter.

8. A toy construction system as recited in claim 7, wherein said connector main body includes a first truncation surface and a substantially diametrically opposed second truncation surface, said first truncation surface extending substantially adjacent the base of said coupling prong in a substantially perpendicular relationship relative to the latter, said coupling prong defining a prong longitudinal axis, said prong longitudinal axis extending in a substantially perpendicular relationship relative to said first and second truncation surfaces, said first and second truncation surfaces being substantially symmetrically disposed relative to a main body axis, the diameter of said connector main body being greatest about said main body main axis so as to define a connector coupling diameter, said connector block contacting surface being located about said component coupling diameter.

9. A toy construction system as recited in claim 8, wherein said connector-to-connector coupling section includes at least one connector coupling aperture formed in said connector main body, said connector coupling aperture being configured, sized and positioned so as to releasably secure at least a portion of the coupling prong of a substantially similar coupling component.

10. A toy construction system as recited in claim 9, wherein said coupling prong is provided with a locking flange substantially adjacent the distal tip thereof, said connector coupling aperture defining an inner rim for abuttingly contacting said locking flange, said coupling prong being configured and sized so that said locking flange abuttingly contacts said inner rim when said coupling prong of a first connector component is inserted in said connector coupling aperture of a second coupling component for releasably coupling and locking said first and second coupling components together in a connecting component coupled configuration.

11. A toy construction system as recited in claim 10, wherein said coupling prong defines a prong stem having a corresponding stem length and a stem diameter, said locking flange extending substantially radially from the peripheral edge of said prong stem, said connector coupling aperture being configured and sized so as to substantially fittingly receive said prong stem.

12. A toy construction system as recited in claim 11, wherein said coupling prong is provided with a resilient prong diameter adjustment means for allowing the resilient deformation of said coupling prong so as to allow the passage of said locking flange when said locking prong is being inserted in the connector coupling aperture of a substantially similar connector component.

13. A toy construction system as recited in claim 12, wherein said prong diameter adjustment means includes a substantially central prong channel extending substantially longitudinally therealong and a prong slot extending substantially longitudinally in the peripheral wall formed by said coupling prong.

14. A toy construction system as recited in claim 8, wherein said connector components each include three connector coupling apertures, the first one of said connector coupling apertures being positioned substantially diametrically opposite said coupling prong, the other two of said connector coupling apertures being positioned in a substantially diametrically opposed relationship relative to each other along a coupling aperture axis substantially symmetrically disposed between said first wall of said connector coupling aperture and said coupling prong.

15. A toy construction system as recited in claim 14, wherein said connector main body includes a substantially centrally disposed main body cavity for substantially fittingly receiving the locking flanges of said coupling prongs of substantially similar coupling components.

* * * * *